US005740631A

United States Patent [19]

Mori

[11] Patent Number: 5,740,631

[45] Date of Patent: Apr. 21, 1998

[54] DOOR APPARATUS AND A METHOD FOR INSTALLING THE SAME IN A DOOR OPENING OF A BUILDING

[75] Inventor: Toshiaki Mori, Yokohama, Japan

[73] Assignee: Abe Kogyo Co., Ltd., Tokyo, Japan

[21] Appl. No.: 709,484

[22] Filed: Sep. 6, 1996

[51] Int. Cl.[6] ..... E06B 1/00

[52] U.S. Cl. ..... 49/380; 206/325

[58] Field of Search ..... 49/380, 504; 206/325

[56] References Cited

U.S. PATENT DOCUMENTS

| | | | |
|---|---|---|---|
| 2,651,814 | 9/1953 | Lester | 49/380 |
| 2,795,327 | 6/1957 | Clay | 206/325 |
| 2,914,817 | 12/1959 | Jackson | 49/380 |
| 2,929,495 | 3/1960 | Simonsen | 206/325 |
| 3,111,724 | 11/1963 | Piekarski | 206/325 |
| 4,850,141 | 7/1989 | Pacca | 49/380 |

FOREIGN PATENT DOCUMENTS

| | | | |
|---|---|---|---|
| 519845 | 2/1955 | Canada | 49/380 |

*Primary Examiner*—Jerry Redman

*Attorney, Agent, or Firm*—Frishauf, Holtz, Goodman, Langer & Chick

[57] ABSTRACT

A frame-and-door unit includes a frame structure and a door. A first vertical frame of the frame structure is supported on one side portion of the door by hinges. When the door is closed, a second vertical frame of the frame structure is supported on the other side portion of the door by a latch bolt and a strike. The unit is bound tight with a band that extends across the door. Each of the vertical frames is formed having a band groove along which the band is passed. The unit, kept bound tight with the band, is fitted into a door opening of a building. The band is cut after the vertical frames are fixed to the edge of the door opening. The cut band is then removed from between the edge of door opening and the vertical frames.

8 Claims, 12 Drawing Sheets

DOOR APPARATUS AND A METHOD FOR INSTALLING THE SAME IN A DOOR OPENING OF A BUILDING

BACKGROUND OF THE INVENTION

1. Field of the Invention

The present invention relates to a door apparatus adapted to be attached to a door opening of a building and a method for installing the door apparatus in the door opening.

2. Description of the Related Art

FIG. 20 shows an arrangement of a generally-known interior door apparatus that is adapted to be installed at the entrance of a room in a building or the like. This door apparatus comprises a frame structure 1, fixed to the edge of a door opening in a building wall, and a door 3 attached to the frame structure 1. The frame structure 1 includes a pair of vertical frames 2*a* and 2*b*, right and left, and an upper frame 2*c* connecting the respective upper ends of the frames 2*a* and 2*b*. One side portion of the door 3 is pivotally supported on the first vertical frame 2*a* by means of hinges 4 in two positions, upper and lower. The door 3 can be swung open on this side of FIG. 20. The lower end portion of each vertical frame extends below the lower edge of the door 3. The respective lower ends of the vertical frames 2*a* and 2*b* are connected by means of a waste frame 8. Each vertical frame is cut to a length H that is equal to the height of the door opening.

A lock body 5 having a latch bolt 5*a* is provided on the other side portion of the door 3. A pair of unlocking handles 6*a* and 6*b* are attached to the outside and inside of the door 3, respectively. An unlocking shaft 6*c* attached to the one handle 6*a* is passed through a through hole 6 in the door 3. The hole 6 is located in alignment with a shaft hole (not shown) in the lock body 5. The second vertical frame 2*b* is provided with a strike 7. The strike 7 has a latch retaining aperture in which the latch bolt 5*a* can be fitted.

In shipping the door apparatus, the door 3 is closed with respect to the frame structure 1, and the latch bolt 5*a* is caused to engage the strike 7. Further, a spacer (not shown) is interposed between the upper edge of the door 3 and the upper frame 2*c*, and a spacer 9 between the lower edge of the door 3 and the waste frame 8. Thus, the door apparatus is packed up with the second vertical frame 2*b* and the door 3 fixed to each other lest they be dislocated in the vertical direction, and is then shipped together with its accessories. The accessories include doorstops, curbs, etc., as well as the handles 6*a* and 6*b*.

In general, the door apparatus is set in the door opening in the building wall in the following processes. First, the lower end portion of each of the vertical frames 2*a* and 2*b* is cut off, depending on the height of the door opening, as shown in FIG. 21. Also, the doorstops and the curbs are cut to a length relative to that of the vertical frames 2*a* and 2*b*. Then, the door 3 is removed from the frame structure 1 in a manner such that the hinges 4 on the door 3 and the frame structure 1 are disengaged from one another, as shown in FIG. 22. Then, the frame structure 1 is fitted into the door opening and positioned. After the frame structure 1 is fixed to the edge of the door opening by means of wood screws or nails, the hinges 4 on the frame structure 1 and the door 3 are connected to one another. Also, the doorstops are attached individually to the respective inner surfaces of the frames 2*a*, 2*b* and 2*c*, and the curbs are attached to the frame structure 1 or the edge of the door opening. The handles 6*a* and 6*b* are attached to the outside and inside of the door 3, respectively.

In some cases, a lower frame 10, called a doorsill, may be attached to the lower part of the frame structure 1, as shown in FIG. 23. In such cases, spacers 11 are inserted individually between the upper edge of the door 3 and the upper frame 2*c* and between the lower edge of the door 3 and the lower frame 10, whereby the vertical frame 2*b* and the door 3 are fixed lest they be able to move in the vertical direction with respect to each other. In the case of a door apparatus provided with the lower frame 10, the respective lower end portions of the vertical frames 2*a* and 2*b* are cut off in positions below the lower frame 10, depending on the height of the door opening. Thereafter, the frame structure 1 is attached to the door opening in the same manner as in the case of the door apparatus shown in FIG. 21.

In setting any of the conventional door apparatuses in the door opening, as described above, the door 3 must be disengaged from the frame structure 1. After the frame structure 1 is fixed to the edge of the door opening, moreover, the door 3 must be attached again to the structure 1. Thus, the installation of the door apparatus requires much time and labor. Since the frame structure 1 of the door apparatus is designed so as to be supported by the edge of the door opening, its strength is not very high. In the door apparatus of this type, the waste frame 8 is removed after the respective lower end portions of the vertical frames 2*a* and 2*b* are cut off, as shown in FIG. 21, so that the second vertical frame 2*b* sometimes may tilt away (in the direction of arrow X) from the door 3, as indicated by two-dot chain line in FIG. 21. In such a case, the strike 7 on the vertical frame 2*b* is disengaged from the latch bolt 5*a*, and the door 3 swings around the hinges 4, so that the frame structure 1 cannot be easily fitted into the door opening. Moreover, the parallelism between the vertical frames 2*a* and 2*b* is ruined. In fixing the frame structure 1 to the edge of the door opening, therefore, the vertical frames 2*a* and 2*b* should be positioned so as to be vertical and parallel to each other by using a scale or some other jig, thus entailing trouble and requiring skilled operation.

In the case of the door apparatus provided with the lower frame 10 shown in FIG. 23, the respective lower ends of the vertical frames 2*a* and 2*b* are connected by means of the lower frame 10. Since the vertical frames 2*a* and 2*b* are as long as 2 meters or thereabout, however, the second vertical frame 2*b* sometimes may bend away from the door 3, as indicted by two-dot chain line, before the frame structure 1 is fitted into the door opening. Inevitably, in this case, the strike 7 will be disengaged from the latch bolt 5*a*.

SUMMARY OF THE INVENTION

Accordingly, the object of the present invention is to provide a door apparatus designed so that a frame structure and a door can be set in a door opening without any deformation of the frame structure in a manner such that the door is attached to the frame structure and a method for installing the door apparatus.

A door apparatus according to the present invention, developed in order to achieve the above object, is an apparatus that is attached to the edge of a door opening of a building, and comprises: a frame structure including first and second vertical frames, extending parallel to each other, and an upper frame, connecting the respective upper ends of the vertical frames, and fixed to the edge of the door opening, the vertical frames individually having transversely continuous grooves in corresponding positions on the respective outer surfaces thereof; a door located inside the frame structure, having one side portion corresponding to the first vertical frame and the other side portion corresponding to the second vertical frame, and constituting a frame-and-door unit in conjunction with the frame structure; hinge means for swingably connecting the one side portion of the door to the first vertical frame; a lock body having a latch bolt provided on the other side portion of the door; a strike provided on the second vertical frame and having a latch retaining aperture capable of releasably receiving the latch bolt, the latch bolt being adapted to get into the latch retaining aperture when the door is closed; and a band passed around and between the first and second vertical frames via the respective grooves thereof with the door closed so that the latch bolt is in the latch retaining aperture, thereby binding the vertical frames and the door tight.

In the door apparatus according to the invention described above, the first vertical frame of the frame structure is supported on the one side portion of the door by means of the hinge means. The second vertical frame is supported on the other side portion of the door in a manner such that the latch bolt is in engagement with the strike. In this state, the whole unit is bound tight with the band that is passed along the band grooves of the vertical frames. Thus, the second vertical frame can be prevented from tilting away from the door or bending outward, so that the strike can be prevented from being disengaged from the latch bolt. Accordingly, the door apparatus can be installed in the door opening with the frame structure and the door in correct positional relation. Since the band is passed along the band grooves in the respective outer surfaces of the vertical frames, it can be easily removed from the frame structure even after the vertical frames are fixed to the edge of the door opening.

An installation method for the door apparatus according to the present invention comprises: a process for forming band grooves in corresponding positions on the respective outer surfaces of the vertical frames, individually, the band grooves being continuous in the transverse direction of the vertical frames; a process for passing a band around and between the vertical frames via the respective band grooves thereof with the door closed with respect to the frame structure, thereby binding the vertical frames and the door tight; a process for cutting off the respective lower end portions of the vertical frames, depending on the height of the door opening; a process for fixing a first curb material to the frame structure or the edge of the door opening; a process for simultaneously fitting the frame structure and the door, kept bound tight with the band, into the door opening; a process for fixing the frame structure to the edge of the door opening; a process for attaching a second curb material to the frame structure; a process for cutting the band after the frame structure is fixed to the edge of the door opening; a process for removing the cut band from the frame structure; and a process for attaching a doorstop material to the frame structure.

In the installation method according to the invention described above, the frame-and-door unit is kept bound tight with the band as it is fitted into the door opening. In this case, an operator in a work space on one side of the door opening can perform the operation for fitting the unit into the door opening, with his or her hands on the band. Further, the work space can be utilized for any of the operations including the fixing of the frame structure to the edge of the door opening, removal of the band, etc. Thus, the installation of the door apparatus in the door opening can be carried out smoothly even though the door of the banded unit cannot be opened.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
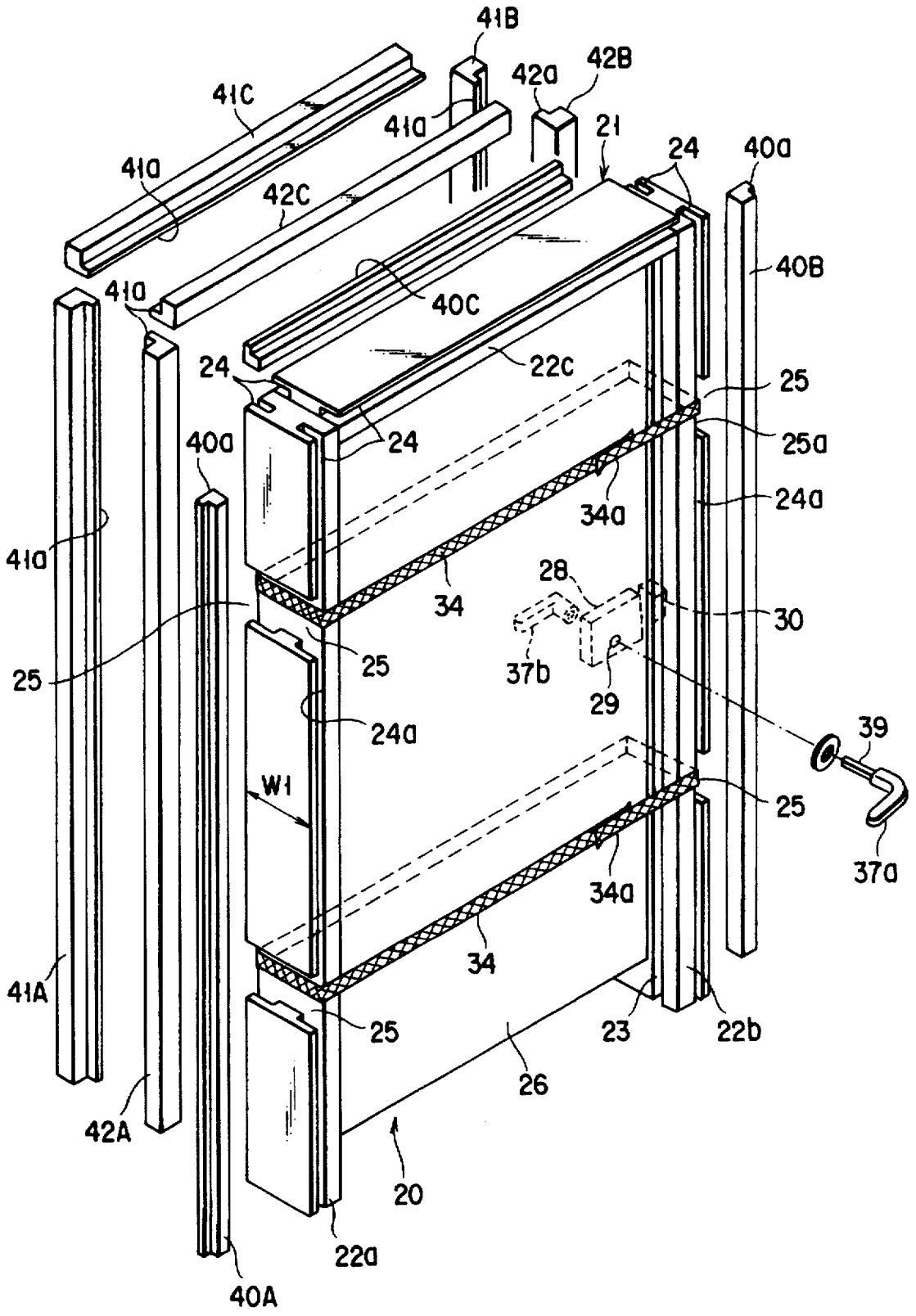
FIG. 1 is an exploded perspective view of a door apparatus furnished with a frame-and-door unit according to a first embodiment of the present invention.

A door apparatus according to an embodiment of the present invention shown in FIG. 1 comprises a frame-and-door unit 20, which is formed of a frame structure 21, a door 26, etc. The door 26 is pivotally supported on the frame structure 21 by means of hinges 27. The unit 20 is bound tight with bands 34, which will be mentioned later. Further, the door apparatus according to the present embodiment comprises doorstops 40A, 40B and 40C, outside curbs (first curbs) 41A, 41B and 41C, inside curbs (second curbs) 42A, 42B and 42C, and the like. These curbs are used to conceal a gap between the edge of a door opening in a partition wall of a building and the frame structure 21.

Figure 2:
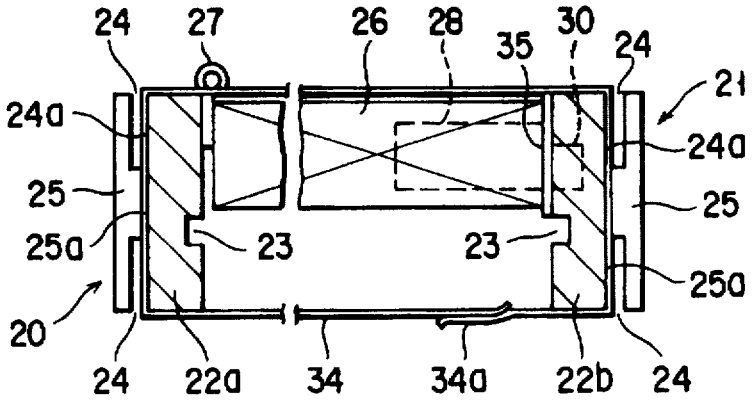
FIG. 2 is a cross-sectional view of a portion through which a band of the unit shown in FIG. 1 is passed.
Figure 3:
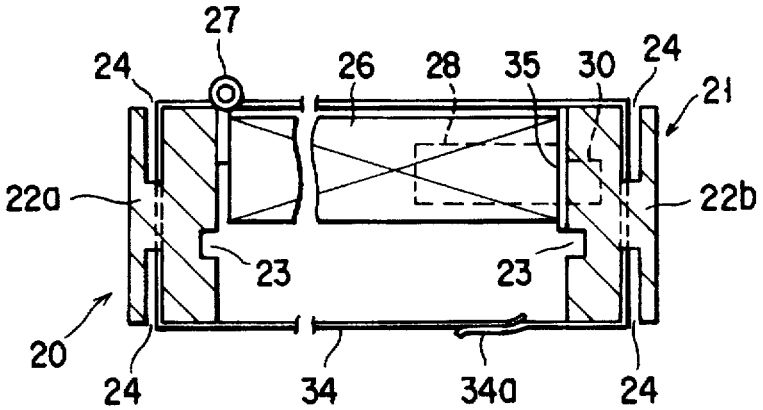
FIG. 3 is a cross-sectional view of a portion through which no band is passed.

The following is a description of the unit 20. As shown in FIGS. 1, 2 and 3, the frame structure 21 includes a parallel pair of wooden vertical frames **22*a* and 22*b*, left and right, and a wooden upper frame 22*c* connecting the respective upper ends of the frames 22*a* and 22*b*. One side portion of the door 26 is pivotally supported on the first vertical frame 22*a* by means of the hinges 27 in two positions, upper and lower. The door 26 can be swung open upward as in FIGS. 2 and 3**.

A groove 23 for mounting each corresponding one of the doorstops 40A, 40B and 40C is formed in the inner surface of each of the frames **22*a*, 22*b* and 22*c* so as to cover the overall length thereof. Grooves 24 for mounting the curbs are formed in the front and rear faces of each of the frames 22*a*, 22*b* and 22*c* so as to cover the overall length thereof. According to this embodiment, the grooves 23 and 24 are formed by partially cutting the frames 22*a*, 22*b* and 22*c*. However, the grooves 24 may be formed by any other means than cutting. Two band grooves 25, upper and lower, are formed in the outer surface of each of the vertical frames 22*a* and 22*b* without interfering with the hinges 27. The grooves 25 of the first and second vertical frames 22*a* and 22*b* are formed by cutting in positions (heights) corresponding to one another. These grooves 25 extend covering the overall width of each of the frames 22*a* and 22*b* in the width direction thereof, that is, in the direction indicated by arrow W1 in FIG. 1. A side face 25*a* of each band groove 25 is flush with door-side faces 24*a* of its corresponding grooves 24**.

Figure 4:
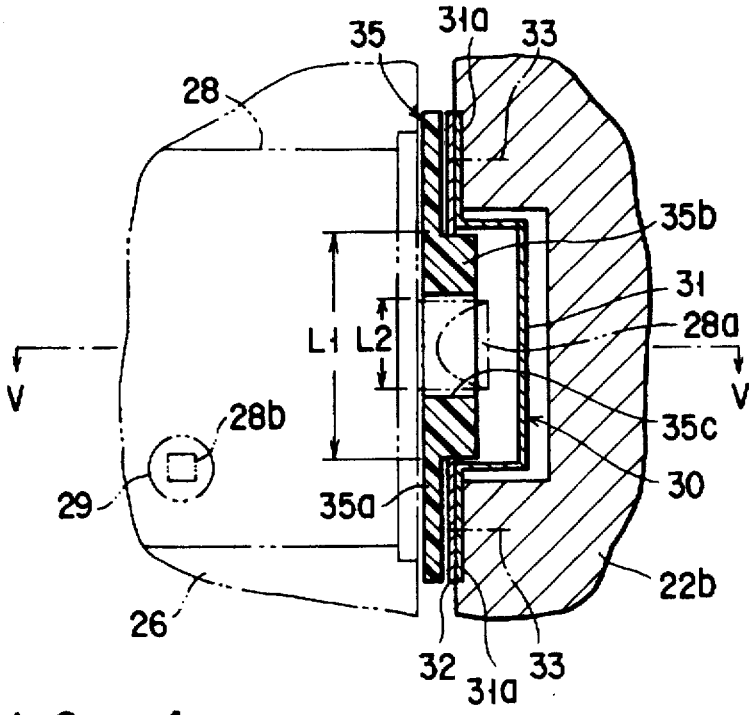
FIG. 4 is a vertical sectional view of a portion provided with a strike of the unit of FIG. 1.

A lock body 28 having a latch bolt **28*a* is provided on the other side portion of the door 26. Unlocking handles 37*a* and 37*b* are attached to the outside and inside of the door 26, respectively. An unlocking shaft 39 attached to the one handle 37*a* is passed through a through hole 29 in the door 26. As shown in FIG. 4, the through hole 29 is located in alignment with a shaft hole 28*b* in the lock body 28. The second vertical frame 22*b* is provided with a strike 30. The strike 30 is situated opposite the latch bolt 28*a*, which can project and recede from a side face of the door 26. The strike 30 is fitted with a latch tacker 35**.

The strike 30 includes a strike box 31 and a strike plate 32. The strike box 31 has an opening on that side thereof which faces the door 26 and upper and lower flange portions **31*a* on either side of the opening. The strike plate 32 has a latch retaining aperture 32*a* in which the latch bolt 28*a* is fitted. The strike box 31 is fitted in a recess that is formed in the second vertical frame 22*b*, and the strike plate 32 is put on the box 31. The strike plate 32 and the flange portions 31*a* are fixed to the inner surface of the vertical frame 22*b* by means of wood screws 33**.

As shown in FIGS. 1 to 3, the unit 20 is bound tight with the bands 34 with the latch bolt bolt **28*a* in engagement with the strike 30. The bands 34 are wound around and across the unit 20 in a manner such that they extend past their corresponding band grooves 25 of the vertical frames 22*a* and 22*b*. The bands 34 are tape-shaped plastic bands for use as packing bands, which may suitably be formed of a thermoplastic synthetic resin, such as polypropylene, that has high tensile strength and is lower in coefficient of friction than wood. Each band 34 is wound tight around the unit 20, and its opposite end portions are connected to each other by using fixing means, such as a band fastener or welding, on the back side of the door 26. In this embodiment, the opposite end portions of each band 34 are fixed at a weld portion 34*a***.

Figure 5:
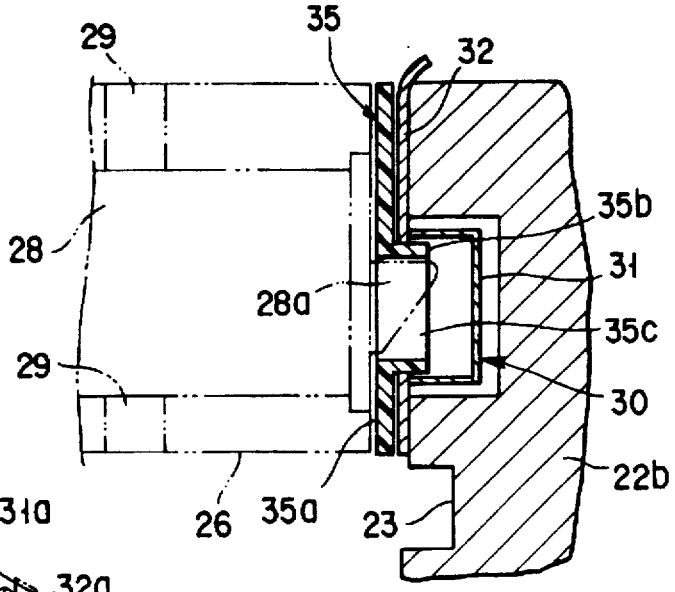
FIG. 5 is a sectional view taken along line V—V of FIG. 4.

As shown in FIGS. 4 and 5, the latch tacker 35 is attached to the strike 30. The tacker 35 is formed having a latch bolt receiving aperture **35*c*. When the door 26 is closed, the latch bolt 28*a* is fitted in the aperture 35*c*. If the unit 20 is bound tight with the bands 34 with the door 26 closed, the second vertical frame 22*b* and the door 26** are fixed to each other lest they be dislocated in the vertical direction.

Figure 6:
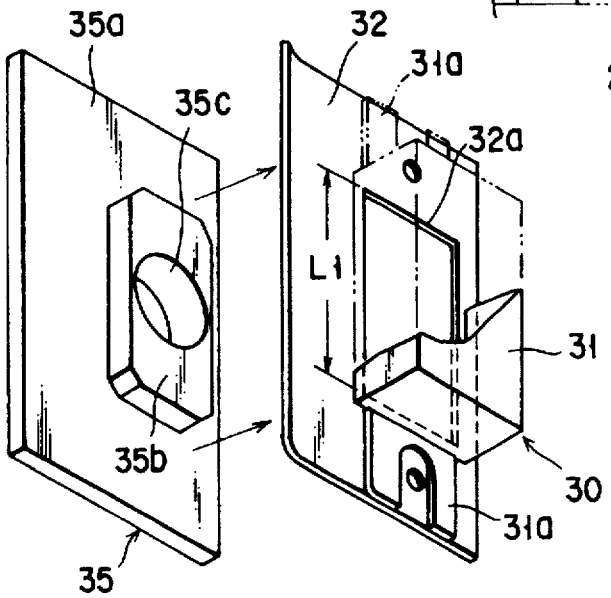
FIG. 6 is a perspective view showing the strike and a latch tacker used in the door apparatus shown in FIG. 1.

A vertical opening width L1 (shown in FIGS. 4 and 6) of the latch retaining hole **32*a*, which is formed in the strike plate 32, is made greater enough than a vertical dimension L2 of the latch bolt 28*a*. This is done in order to enable the latch bolt 28*a* to be fitted in the latch retaining hole 32*a* even if the mounting position for the strike 30 is dislocated to some degree in the vertical direction. Thus, the second vertical frame 22*b* and the door 26 cannot be prevented from moving in the vertical direction by only fitting the latch bolt 28*a* into the latch retaining hole 32*a*. In this embodiment, therefore, the second vertical frame 22*b* and the door 26 is prevented from moving in the vertical direction by using the latch tacker 35**.

The latch tacker 35 is an integrally molded product of a synthetic resin, such as polyvinyl chloride, and includes a planar portion **35*a* having an area substantially equal to that of the strike plate 32. A projection 35*b* is formed integrally on the back side of the planar portion 35*a*. The projection 35*b* has a shape such that it can be fitted substantially tight in the latch retaining aperture 32*a* of the plate 32. A latch bolt receiving aperture 35*c* is formed in the projection 35*b*. The aperture 35*c* has an inside diameter such that the latch bolt 28*a* can be fitted substantially tight therein. The latch tacker 35 is attached to the strike 30 by fitting the projection 35*b* into the aperture 32*a***.

Figure 7:
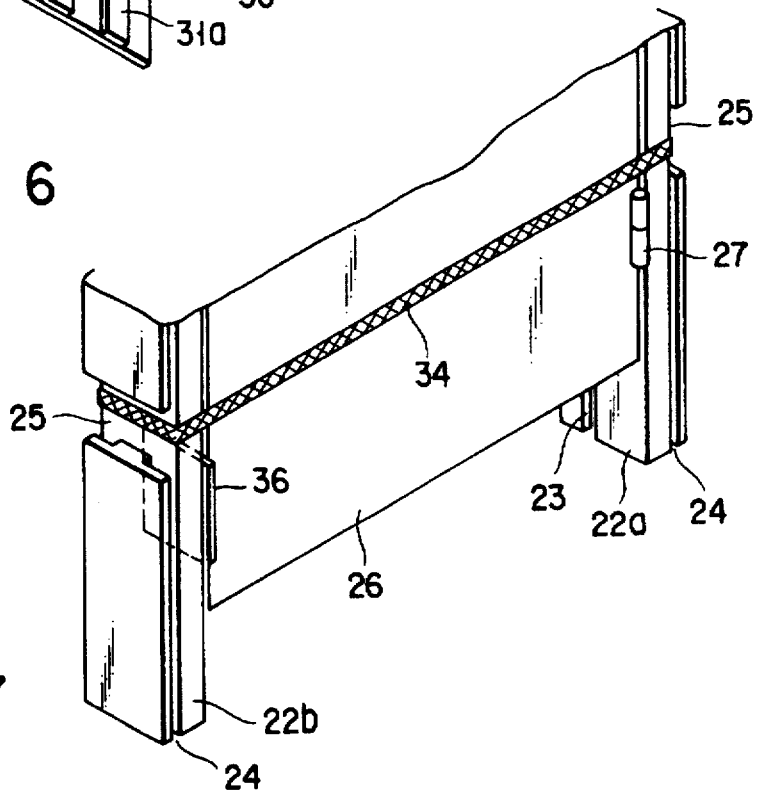
FIG. 7 is a perspective view of the lower part of the unit of FIG. 1, taken from the outside of the door apparatus.

The planar portion **35*a* of the latch tacker 35 serves also as a spacer that is sandwiched between the second vertical frame 22*b* and the door 26. As shown in FIG. 7, a spacer 36 is sandwiched between the door 26 and each of the upper and lower end portions of the frame 22*b*. When the unit 20 is bound tight with the bands 34, the second vertical frame 22*b*, along with the planar portion 35*a* and the spacers 36, is pressed against the side face of the door 26**.

Any of the doorstops 40A, 40B and 40C and the curbs 41A, 41B, 41C, 42A, 42B and 42C shown in FIG. 1 are formed by cutting wood. The doorstops 40A, 40B and 40C are formed having their respective ridges **40*a*, which extend throughout the length and are adapted to be fitted in the grooves 23 of the frames 22*a*, 22*b* and 22*c*, respectively. Likewise, the curbs 41A to 41C and 42A to 42C are formed having their respective ridges 41*a* and 42*a*, which extend throughout the length and are adapted to be fitted in the grooves 24 of their corresponding frames 22*a*, 22*b* and 22*c*. The lower end portion of each of the vertical frames 22*a* and 22*b* extends downward for some extra length from the lower edge of the door 26 so that it can be cut to a length corresponding to the height of the door opening in the building wall. The vertical doorstops 40A and 40B and the vertical curbs 41A, 41B, 42A and 42**B also have some extra length for allowance such that they can be cut to a length corresponding to the vertical frames.

Figure 8:
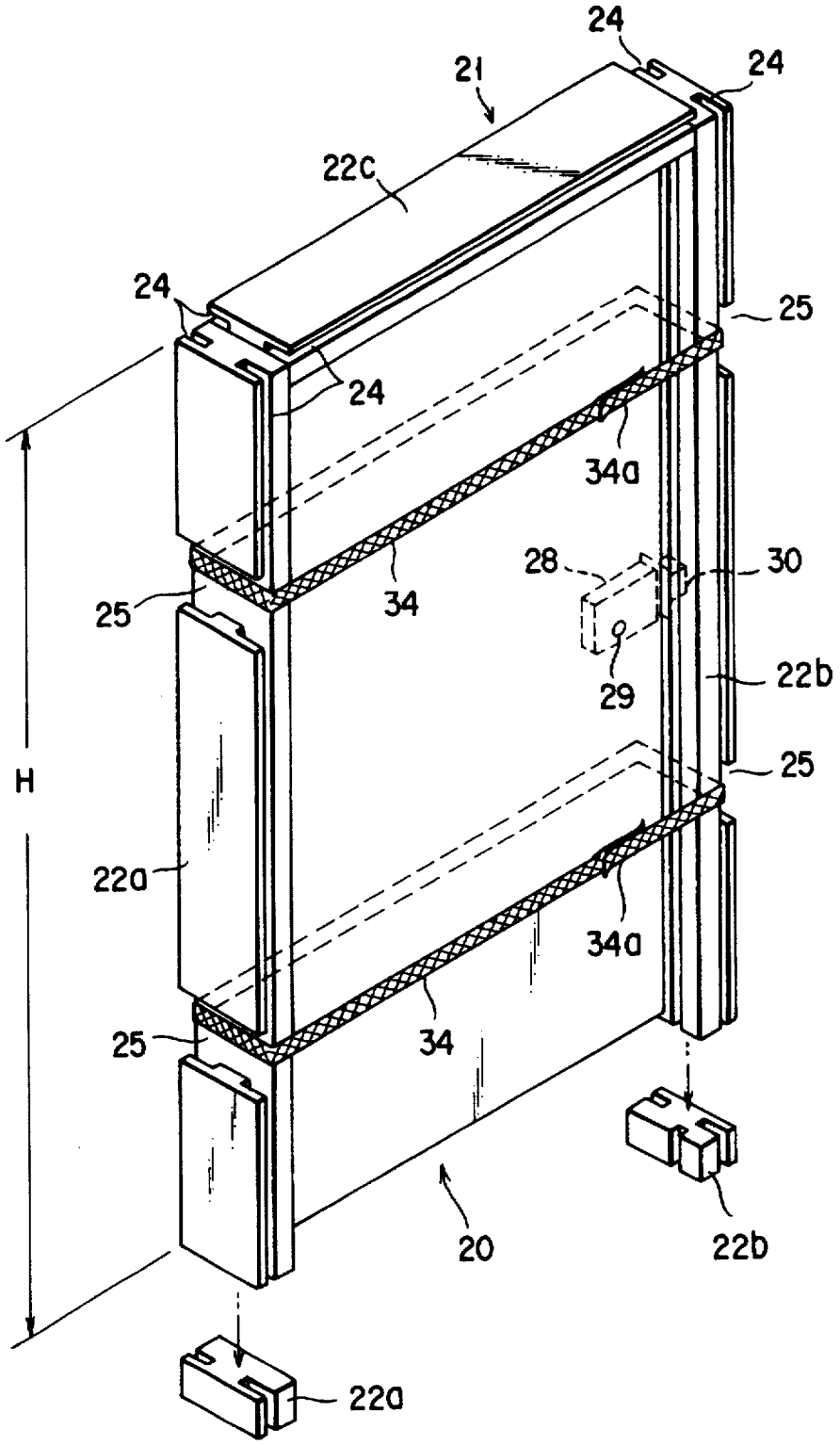
FIG. 8 is a perspective view showing the unit of FIG. 1 with the respective lower end portions of its vertical frames cut off.
Figure 9:
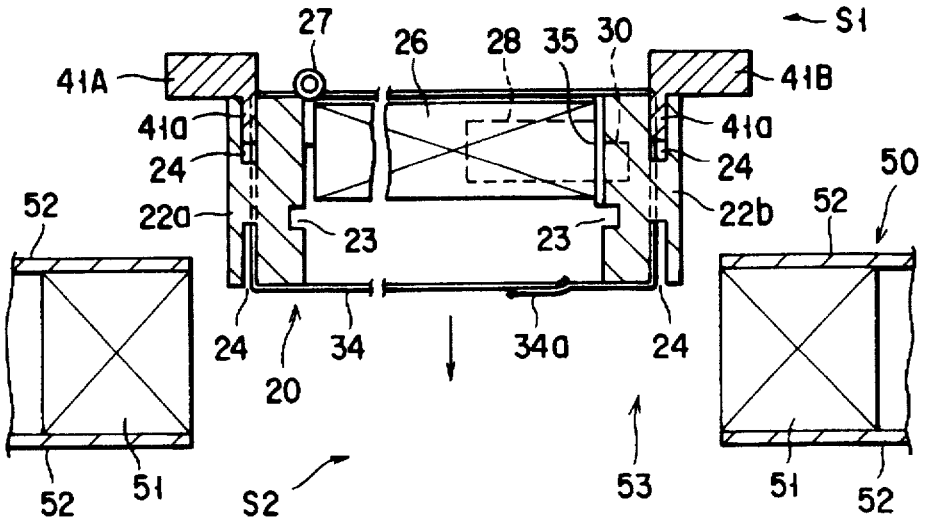
FIG. 9 is a cross-sectional view showing the way the unit of FIG. 1 is fitted into a door opening.
Figure 10:
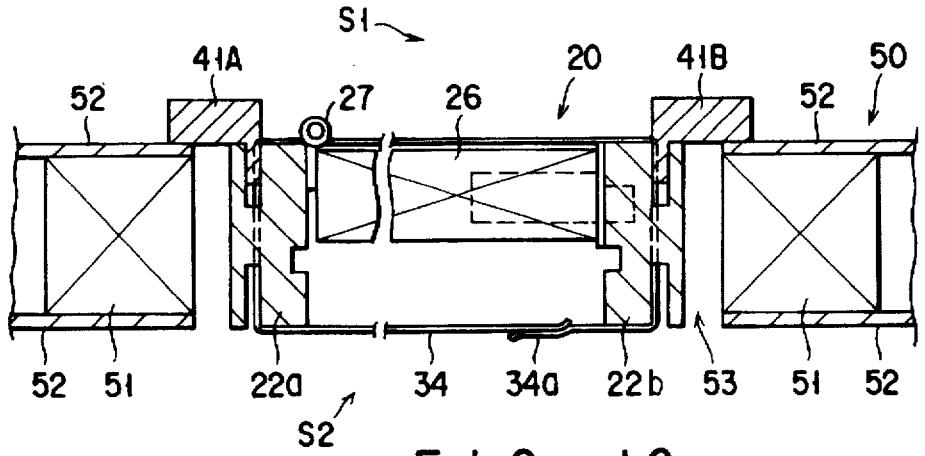
FIG. 10 is a cross-sectional view showing the unit of FIG. 1 fitted in the door opening.
Figure 11:
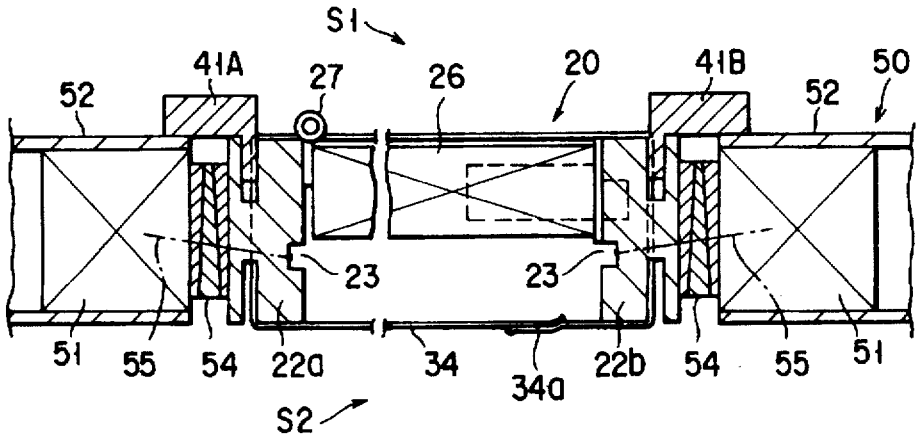
FIG. 11 is a cross-sectional view showing the unit of FIG. 1 fixed to the edge of the door opening.

The following is a description of the way the door apparatus according the aforementioned embodiment is set in the door opening in the partition wall of the building. First, the lower end portion of each of the vertical frames 22*a* and 22*b* is cut off so that the frame has a length H corresponding to the height of the door opening, as shown in FIG. 8. Also, the doorstops 40A and 40B and the curbs 41A, 41B, 42A and 42B are cut corresponding to the length H of the vertical frames 22*a* and 22*b*. In FIGS. 9, 10 and 11, numerals 50, 51 and 52 denote the partition wall, an adjacent pair of pillars, and wall panels, respectively. The door opening 53 is defined by the pillars 51 and a beam (not shown) connecting the respective upper end portions of the pillars 51.

As shown in FIG. 9, the curbs 41A, 41B and 41C are attached to the frames 22*a*, 22*b* and 22*c*, respectively. The frame-and-door unit 20 is kept bound tight with the bands 34 as it is fitted into the door opening 53 and positioned in the manner shown in FIG. 10. In this fitting process, an adhesive is fed in advance into gaps between the respective ridges 41*a* of the curbs 41A to 41C and the grooves 24, and the ridges 41*a* are inserted into the grooves 24, individually. The adhesive is kept away from the regions for the passage of the bands 34. Since the ridge 41*a* of each of the curbs 41A to 41C is tapered so that its edge portion is in the form of a knife edge, it can be easily inserted into its corresponding groove 24.

The unit 20 is fitted into the door opening 53 in the following manner. In this embodiment, the unit 20 is carried into a space S1 on the upper side of FIG. 9, and is opposed to the door opening 53. Then, an operator gets into a work space S2 through the door opening 53, and pulls the unit 20 into the opening 53. Then, the curbs 41A to 41C are caused to abut against the panels 52 at the door opening 53, as shown in FIG. 10. Since the unit 20 is wound with the bands 34, only one person in the work space S2 can pull the unit 20 into the opening 53 with his or her hands on the vertical frames 22*a* and 22*b* and/or the bands 34.

After the fitting process is finished, tapered liners 54 are driven into gaps between the frames 22*a*, 22*b* and 22*c* and the inner surface of the door opening 53, as shown in FIG. 11. Thereafter, the frames 22*a*, 22*b* and 22*c* are fixed to the pillars 51 and the beam by means of wood screws 55 or nails inside the grooves 23.

Figure 12:
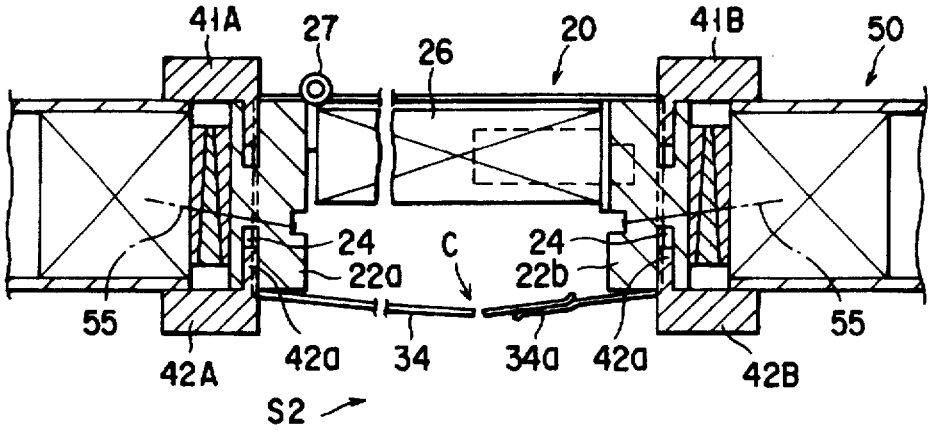
FIG. 12 is a cross-sectional view showing a state in which the band on the unit of FIG. 1 is cut.

Then, the inside curbs 42A, 42B and 42C are attached to the frames 22*a*, 22*b* and 22*c*, respectively, as shown in FIG. 12. As in the case of the outside curbs 41A to 41C, the adhesive is fed in advance into gaps between the respective ridges 42*a* of the inside curbs 42A to 42C and the grooves 24, and the ridges 42*a* are inserted into the grooves 24, individually. The adhesive is kept away from the regions for the passage of the bands 34. Since the ridge 42*a* of each of the curbs 42A to 42C is also tapered so that its edge portion is in the form of a knife edge, it can be easily inserted into its corresponding groove 24.

Figure 13:
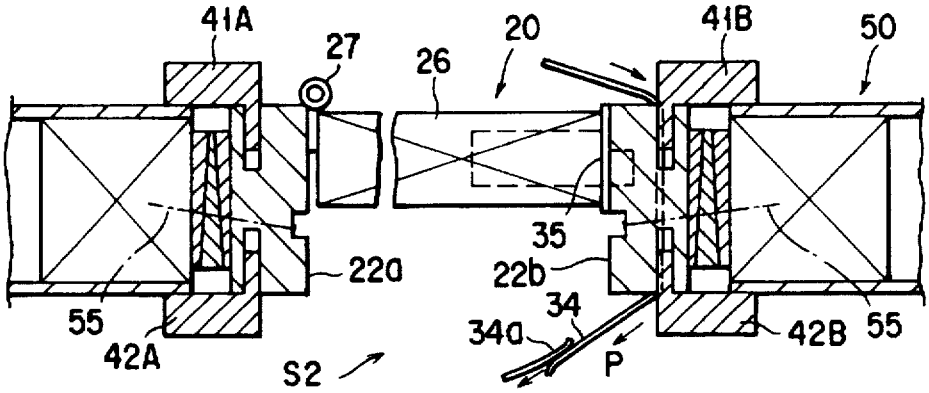
FIG. 13 is a cross-sectional view showing the way the band is removed from the unit of FIG. 1.

After the frames 22*a*, 22*b* and 22*c* are thus fixed to the edge of the door opening 53, each band 34 is cut off at any desired point C in the work space S2, as shown in FIG. 12. Thereafter, each band 34 is removed in a manner such that its one end side (on which the weld portion 34*a* remains) is pulled in the direction of arrow P, as shown in FIG. 13. Before it is removed, each band 34 extends past its corresponding band grooves 25 of the vertical frames 22*a* and 22*b*. Even after the frame structure 21 is fixed to the edge of the door opening 53, therefore, the bands 34 can be smoothly removed with ease. Each band 34 is held between the respective side faces 25*a* of its corresponding band grooves 25 and the ridges 41*a* and 42*a*. Since bands 34 are as thin as 0.2 mm to 1.0 mm and about 1 cm to 3 cm wide and are formed of a smooth-faced plastic material, such as polypropylene, they can be removed by being pulled with some great force. The bands 34 can be removed more easily if the side face 25*a* of each band groove 25 is recessed from the side face 24*a* of each groove 24 toward the door 26. The bands 34 may be removed at any time after the frame structure 21 is fixed to the edge of the door opening 53 by means of the fixing members 55. Thus, the bands 34 may be removed before the attachment of the inside curbs 42A to 42C.

Figure 14:
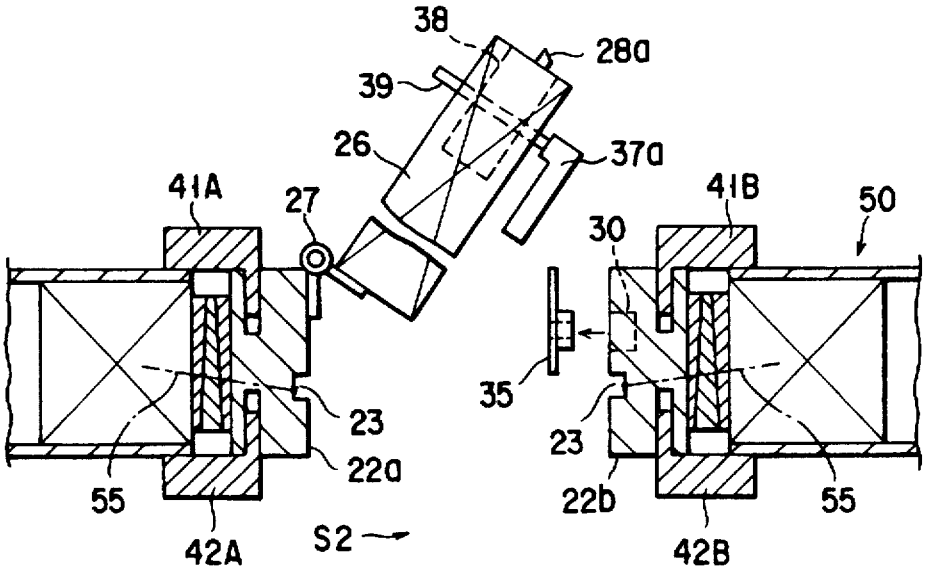
FIG. 14 is a cross-sectional view showing the door apparatus of FIG. 1 with its door open.
Figure 15:
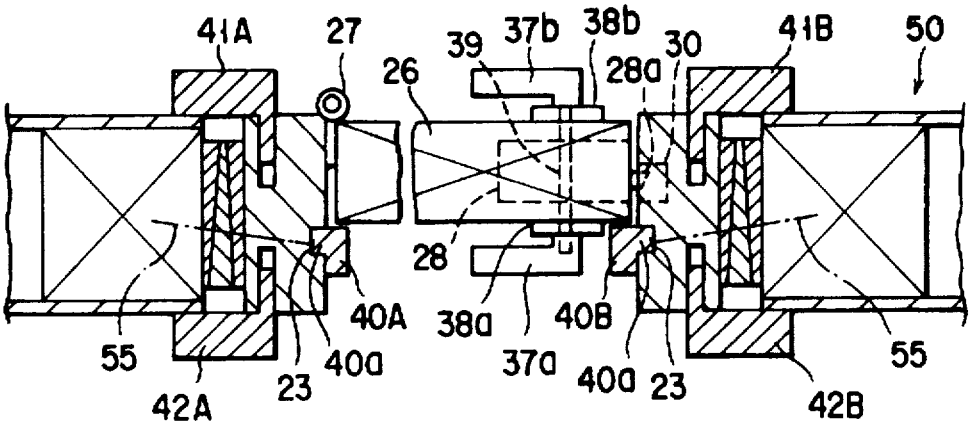
FIG. 15 is a cross-sectional view showing the door apparatus of FIG. 1 fitted with doorstops.

After the bands 34 are removed, the spacers (shown in FIG. 7) are disengaged from the unit 20, and the door 26 is opened by releasing the lock body 28 in the work space S2, as shown in FIG. 14. Further, the latch tacker 35 is disengaged from the strike 30. In releasing the lock body 28, an unlocking tool or the unlocking shaft 39 of the handle 37*a* is rotated in an unlocking direction. As shown in FIG. 15, the doorstops 40A, 40B and 40C are attached to the inner surfaces of the frames 22*a*, 22*b* and 22*c*, respectively. The adhesive is fed in advance into gaps between the respective ridges 40*a* of the doorstops 40A to 40C and the grooves 23, so that the ridges 40*a* and the grooves 23 can be fixed together by inserting the former into the latter.

Figure 16:
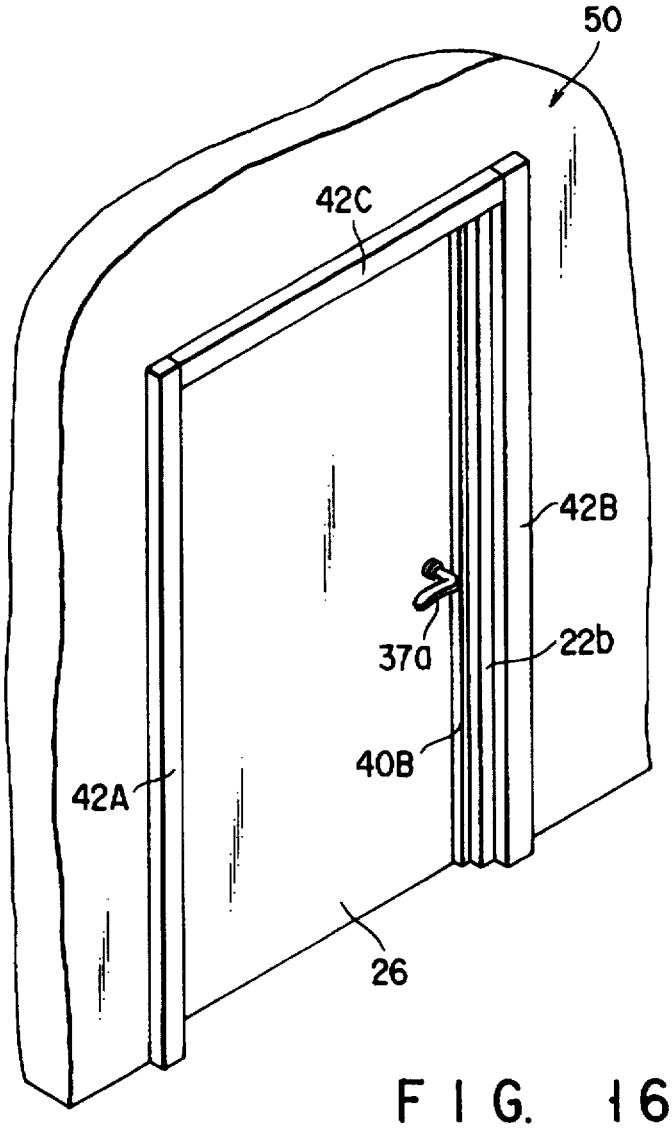
FIG. 16 is a perspective view showing the door apparatus set in the door opening.

The unlocking shaft 39 of the one handle 37*a* is passed through the through hole 29 in the door 26 and the shaft hole 28*b* in the lock body 28, and a handle seat 38 is screwed to the door 26. The other handle 37*b* is fitted onto the unlocking shaft 39, and a handle seat 38*b* is screwed to the door 26. In this manner, the handles 37*a* and 37*b* are attached to the outside and inside of the door 26, respectively, whereupon the installation of the door apparatus is completed, as shown in FIG. 16. Since the doorstops 40A to 40C, curbs 41A to 41C and 42A to 42C, and frames 22*a* to 22*c* are coated in advance, they need not be coated after the installation of the door apparatus is finished.

In this embodiment, the frame-and-door unit 20 is bound tight with the bands 34 before it is fixed to the door opening 53. Besides, the first vertical frame 22*a* is supported on the one side portion of the door 26 by means of the hinges 27, while the second vertical frame 22*b* is supported on the other side portion of the door 26 by means of the latch tacker 35 and the strike 30. Accordingly, there is no possibility of the second vertical frame 22*b* tilting away from the door 26 or bending outward or the strike 30 being disengaged from the latch bolt 28*a*, so that the door 26 can be prevented from opening unexpectedly.

The door apparatus constructed in this manner can be set in the door opening 53 with the door 26 attached to the frame structure 21 in correct positional relation. Since the bands 34 can be easily removed after the structure 21 is fixed to the door opening 53, moreover, the time and labor for the installation of the door apparatus can be saved. Further, the latch bolt 28*a* is fitted substantially tight in the latch bolt receiving aperture 35*c* of the latch tacker 35 that is attached to the strike 30. Therefore, the tacker 35 can prevent the second vertical frame 22*b* and the door 26 from being vertically dislocated with respect to each other. In this case, a spacer need not be inserted between the top face of the door and the upper frame or between the underside of the door and a lower frame.

In the installation method described above, furthermore, the unit 20 is kept bound tight with the bands 34 as it is fitted into the door opening 53. In this case, the work space S2 on one side of the door opening 53 can be utilized for any of the operations including the introduction of the unit 20 into the opening 53, fixing of the frame structure 21 to the edge of the door opening 53, and removal of the bands 34. Thus, the aforesaid series of operations can be carried out smoothly even though the door 26 of the banded unit 20 cannot be opened.

Figure 17:
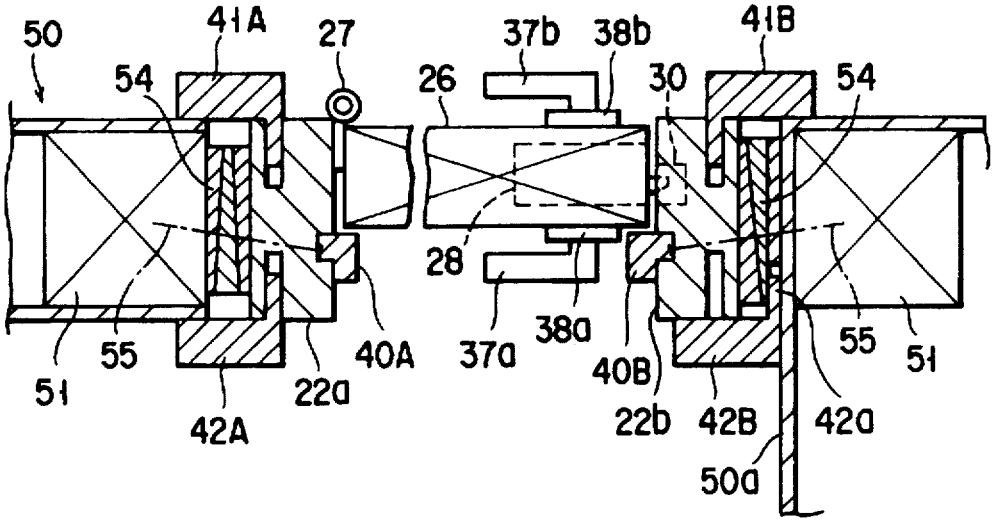
FIG. 17 is a cross-sectional view of a modification of the door apparatus in which curbs are attached in a different manner.

The curbs 41A to 41C and 42A to 42C should only be attached to either the frame structure 21 or the door opening 53, depending on circumstances. FIG. 17 shows a case in which a wall 50*a* on the side of the second vertical frame 22*b* extends at right angles to the door 26. In this modification, the ridge 42*a* of the curb 4lB is inserted between the one wall 50*a* and a liner 54.

Figure 18:
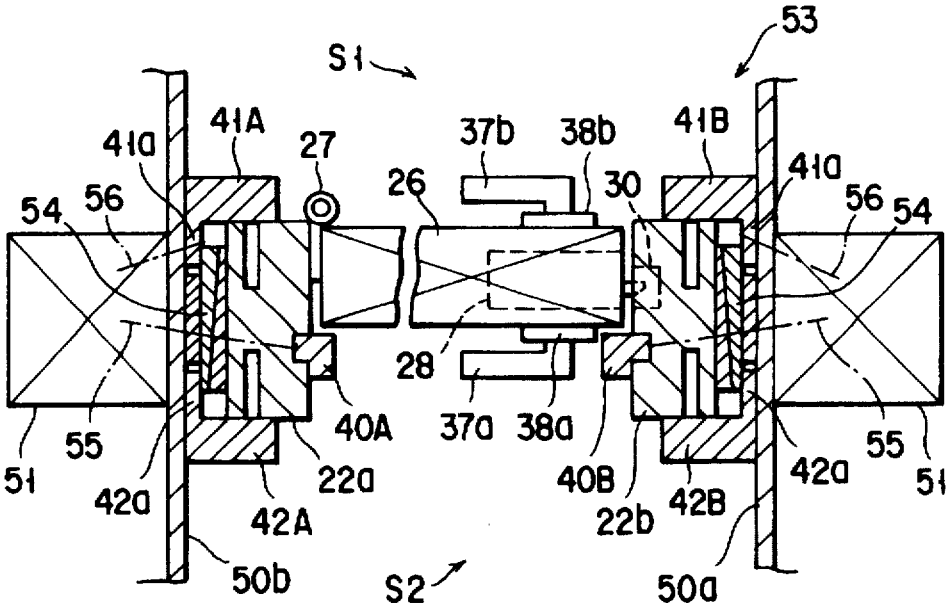
FIG. 18 is a cross-sectional view of a modification of the door apparatus in which walls defining the door opening are arranged in a different manner.

FIG. 18 shows a case in which the door is installed in the middle of a corridor, for example. In this case, walls 50*a* and 50*b* of the door opening 53 extend at right angles to the door 26. In this modification, the respective ridges 41*a* of the outside and inside curbs 41A to 41C and 42A to 42C are inserted individually between the partition walls 50*a* and 50*b* and their corresponding liners 54. The door apparatus shown in FIG. 18 is mounted in the door opening 53 in the following manner. First, the respective ridges 41*a* of the outside curbs 41A to 41C are fixed to the walls 50*a* and 50*b* by means of wood screws 56 or nails in predetermined positions. Thereafter, the unit 20, bound tight with the bands 34, is fitted into the door opening 53. According to this modification, the unit 20 is carried into the work space S2 on the lower side of FIG. 18, and is opposed to the door opening 53. Then, the operator pushes the unit 20 from the space S2 toward the curbs 41A to 41C with his or her hands on the bands 34 and the like, thereby causing the frame structure 21 to abut against the curbs 41A to 41C. Thereafter, the liners 54 are driven individually into gaps between the vertical frames 22*a* and 22*b* and the walls 50*a* and 50*b*, and the frames 22*a* and 22*b* are fixed to the pillars 51 by means of the wood screws 55 or nails inside the grooves 23. Thereafter, the inside curbs 42A to 42C are attached to the frame structure 21. As in the case of the foregoing embodiment, moreover, the bands 34 are removed from the unit 20, the doorstops 40A to 40C are attached to the frame structure 21, and the handles 37*a* and 37*b* are attached to the door 26.

Figure 19:
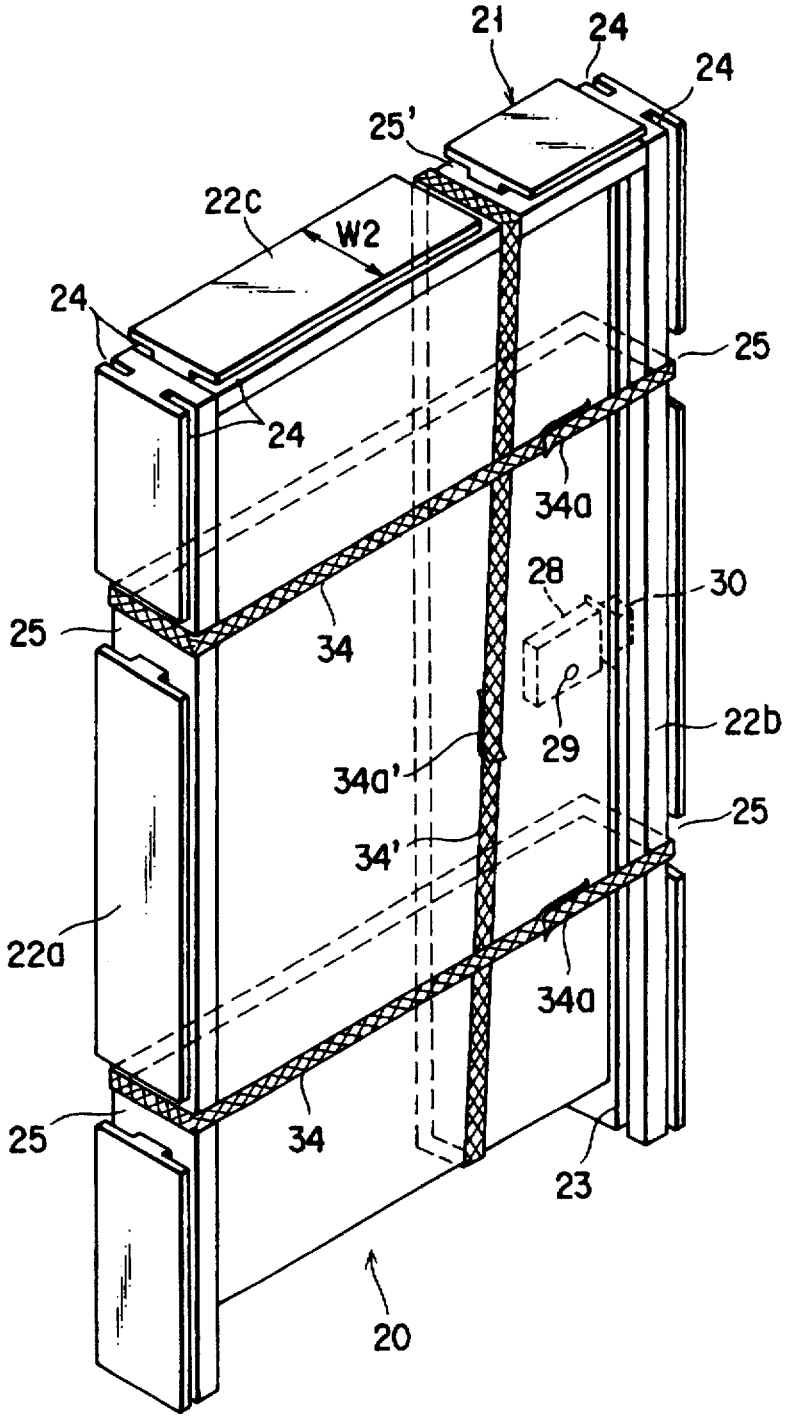
FIG. 19 is a perspective view of a frame-and-door unit according to a second embodiment of the invention.

FIG. 19 shows a frame-and-door unit 20 according to a second embodiment of the present invention. The unit 20 is formed having a second band groove 25' in the upper surface of the upper frame 22*c*, besides the band grooves 25 of the vertical frames mentioned in connection with the first embodiment. The groove 25' is formed so as to cover the overall width of the upper frame 22*c* or the overall length in the direction indicated by arrow W2 in FIG. 19. Each first band groove 25, like the one according to the first embodiment, is wound with the band 34 across the door 26. A second band 34' is wound vertically on the door 26 so as to pass around and between the second band groove 25' of the upper frame 22*c* and the underside of the door 26. In the case of this unit 20, it is advisable to interpose a spacer (not shown) between the top face of the door 26 and the upper frame 22*c*. Since the upper frame 22*c* is pulled toward the door 26 by the second band 34', the second vertical frame 22*b* and the door 26 are prevented from moving in the vertical direction with respect to each other. Other components are arranged in the same manner as those of the unit 20 according to the first embodiment.

Figure 20:
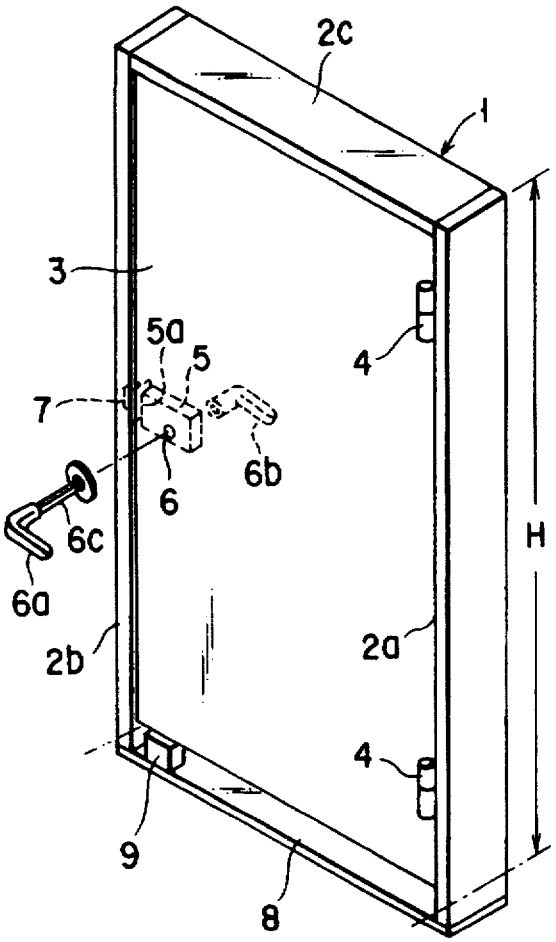
FIG. 20 (PRIOR ART)
FIG. 20 is a perspective view of a conventional door apparatus.
Figure 21:
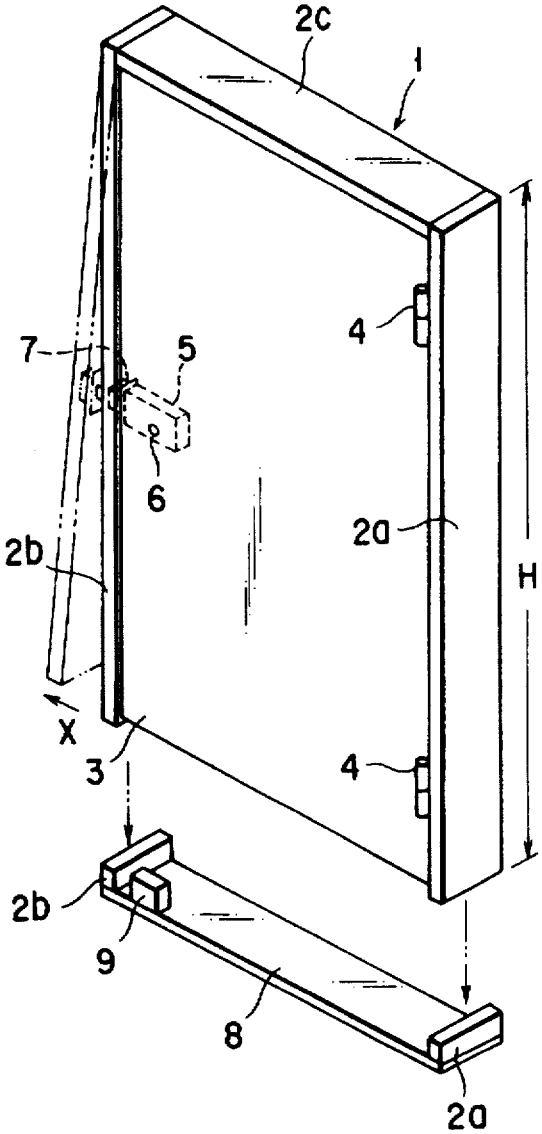
FIG. 21 (PRIOR ART)
FIG. 21 is a perspective view showing the door apparatus of FIG. 20 with the respective lower parts of its vertical frames cut off.
Figure 22:
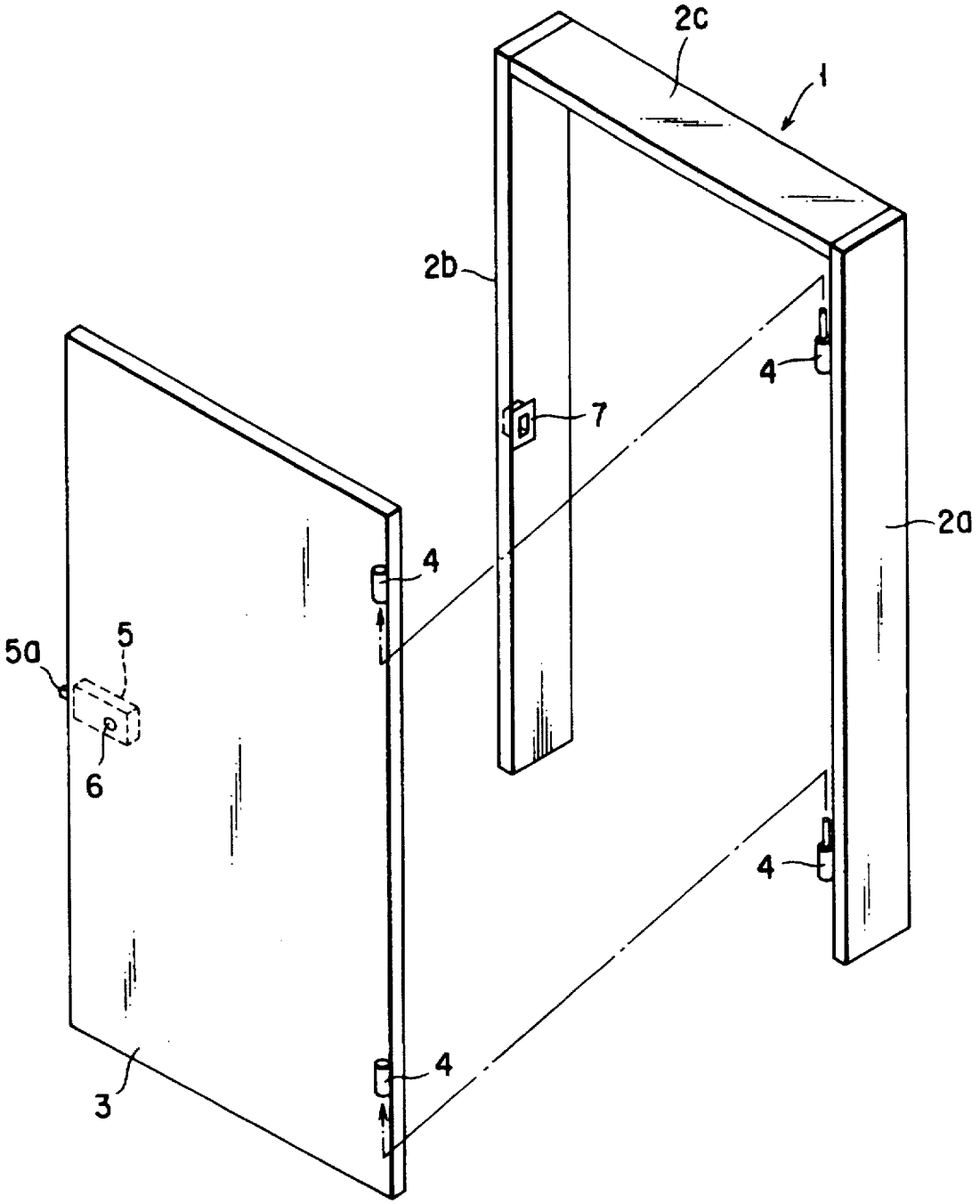
FIG. 22 (PRIOR ART)
FIG. 22 is a perspective view showing the door apparatus of FIG. 20 with its door disengaged from its frame structure.
Figure 23:
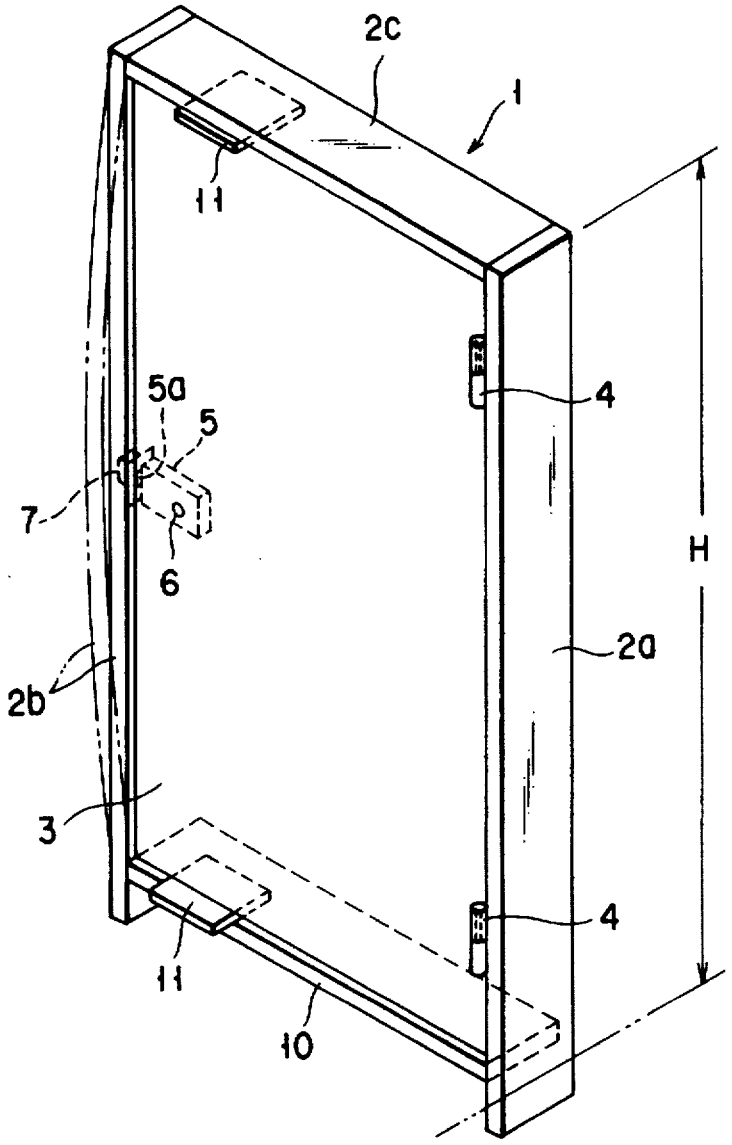
FIG. 23 (PRIOR ART)
FIG. 23 is a perspective view of a conventional door apparatus provided with a doorsill.

In this second embodiment, the vertical second band 34', like the horizontal first bands 34, has its opposite end portions connected by welding or by means of a band fastener on the back side of the door 26, for example. Numeral 34*a*' denotes a weld portion. The second band 34', like the first bands 34, is removed from the frame structure 21 after the structure 21 is fixed to the edge of the door opening. The first and second bands 34 and 34' used may be one or two or more in number each. The frame structure 21 may be provided with a waste frame 8 attached to the respective lower end portions of the vertical frames 22*a* and 22*b*, as shown in FIG. 20, or a doorsill, such as the one shown in FIG. 23.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A door apparatus attachable to an edge of a door opening, said door apparatus comprising:

a frame structure fixable to the edge of the door opening, said frame structure including first and second vertical frames extending parallel to each other, and an upper frame connecting respective upper ends of the first and second vertical frames, said first and second vertical frames each having a transversely continuous groove in corresponding positions on respective outer surfaces thereof;

a door provided inside the frame structure, said door having a first side portion corresponding to the first vertical frame and a second side portion corresponding to the second vertical frame;

a hinge for swingably connecting the first side portion of the door to the first vertical frame;

a lock body having a latch bolt provided on the second side portion of the door;

a strike provided on the second vertical frame and having a latch retaining aperture for releasably receiving the latch bolt when the door is closed; and a band passed around and between the first and second vertical frames via the respective transversely continuous grooves thereof with the door closed so that the latch bolt is received in the latch retaining aperture, thereby binding the first and second vertical frames and the door together.

2. A door apparatus according to claim 1, further comprising doorstops arranged on an inner surface of the frame structure and adapted to support the door from behind when the door is closed.

3. A door apparatus according to claim 1, further comprising curb materials arranged individually on side surfaces of the frame structure so as to conceal a gap between the edge of the door opening and the frame structure.

4. A door apparatus according to claim 1, further comprising a latch tacker insertable into the latch retaining aperture of the strike and including a latch bolt receiving portion, said latch bolt receiving portion being located in a position corresponding to the latch bolt when the door is closed and having a size such that the latch bolt can be fitted therein.

5. A door apparatus according to claim 1, wherein said band comprises a synthetic resin having a coefficient of friction lower than that of wood, and has a thickness of 0.2 mm to 1.0 mm and a width of 1 cm to 3 cm.

6. A door apparatus according to claim 5, wherein said band comprises a thermoplastic synthetic resin, and opposite end portions thereof are fixed to each other by heat welding in a manner such that the band is wound on the frame structure and the door, which together form a frame-and-door unit.

7. A door apparatus according to claim 6, wherein said thermoplastic synthetic resin comprises polypropylene.

8. A door apparatus according to claim 1, further comprising a groove formed on an upper surface of the upper frame of the frame structure so as to be continuous in a transverse direction of the upper frame, and a vertical second band passed around and between the groove of the upper frame and an underside of the door in order to bind the upper frame and the door together.

* * * * *